US010549435B2

(12) United States Patent
Padget

(10) Patent No.: US 10,549,435 B2
(45) Date of Patent: Feb. 4, 2020

(54) OSCILLATING TOOL WITH MODIFIED MOUNTING INTERFACE FOR INCREASING CUT DEPTH

(71) Applicants: Robert Bosch Tool Corporation, Broadview, IL (US); Robert Bosch GmbH, Stuttgart (DE)

(72) Inventor: Bradley D Padget, Huntley, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 202 days.

(21) Appl. No.: 14/985,895

(22) Filed: Dec. 31, 2015

(65) Prior Publication Data

US 2016/0185003 A1 Jun. 30, 2016

Related U.S. Application Data

(60) Provisional application No. 62/098,785, filed on Dec. 31, 2014.

(51) Int. Cl.
*B27B 19/00* (2006.01)
*B26B 7/00* (2006.01)

(52) U.S. Cl.
CPC ..... *B26B 7/00* (2013.01); *B27B 19/006* (2013.01)

(58) Field of Classification Search
CPC ..... B27B 19/006; B27B 19/008
See application file for complete search history.

(56) References Cited

U.S. PATENT DOCUMENTS 4,073,324 A * 2/1978 Mayer ..... B23Q 5/02 144/2.1
4,106,181 A * 8/1978 Mattchen ..... A61C 3/12 279/77
D343,247 S * 1/1994 Walen ..... D24/146
6,656,186 B2 * 12/2003 Meckel ..... A61B 17/142 30/350
8,920,424 B2 * 12/2014 Boykin ..... A61C 3/12 606/82
D728,646 S * 5/2015 Accola ..... D15/139
2011/0219929 A1 * 9/2011 Mann ..... B23D 61/006 83/607
2011/0266759 A1 * 11/2011 Goldman ..... B24B 23/04 279/106
2012/0311876 A1 * 12/2012 Zhang ..... B23D 61/006 30/347

(Continued)

*Primary Examiner* — Kenneth E Peterson
(74) *Attorney, Agent, or Firm* — Maginot, Moore & Beck LLP

(57) ABSTRACT

An accessory tool for an oscillating tool includes a first metal plate and a second metal plate fixed together to form a body having a first end portion formed by the first metal plate and a second end portion formed by the second metal plate. The first end portion defines a linear cutting edge, and the second end portion defines a drive interface for mounting the accessory tool onto a tool holder of an oscillating tool. The second metal plate includes an overlapping portion that overlaps a portion of the first metal plate. At least one of a first lateral portion and a second lateral portion of a leading edge of the overlapping portion is spaced farther away from the cutting edge than a central portion of the leading edge of the overlapping portion.

7 Claims, 5 Drawing Sheets

(56) References Cited

U.S. PATENT DOCUMENTS

| | | | | |
|---|---|---|---|---|
| 2014/0325855 | A1* | 11/2014 | Bozic | B23D 61/006<br>30/392 |
| 2017/0182570 | A1* | 6/2017 | Dvorak | B23D 51/00 |
| 2018/0117687 | A1* | 5/2018 | Rubens | B23D 51/10 |

* cited by examiner

OSCILLATING TOOL WITH MODIFIED MOUNTING INTERFACE FOR INCREASING CUT DEPTH

CROSS-REFERENCE TO RELATED APPLICATIONS

This application claims priority to U.S. Provisional Application Ser. No. 62/098,785 entitled "OSCILLATING TOOL WITH MODIFIED MOUNTING INTERFACE FOR INCREASING CUT DEPTH" by Padget, filed Dec. 31, 2014, the disclosure of which is incorporated herein by reference in its entirety.

TECHNICAL FIELD

This invention relates to the field of oscillating power tools, and more particularly to accessory tools for use with oscillating power tools.

BACKGROUND

Oscillating power tools are lightweight, handheld tools configured to oscillate various accessory tools and attachments, such as cutting blades, sanding discs, grinding tools, and many others. Accessory tools enable an oscillating power tool to be used to perform a wide variety of tasks from cutting woods and metals to polishing and grinding stone and masonry. Each accessory tool, however, typically is configured to perform only certain types of tasks on certain types of materials.

Referring to FIG. 1, previously known cutting accessory tools for an oscillating tool have a mounting portion and a blade portion. The mounting portion is configured to be secured to the drive of oscillating tool. The blade portion extends outwardly from the mounting portion and has a leading edge that is serrated or sharpened to serve as the cutting edge for the accessory tool.

As can be seen in FIG. 1, the mounting portion and blade portion of cutting blade accessory tools are typically formed by separate metal plates that are secured to each other, e.g., by welding. This allows the mounting portion to be formed by a thicker metal plate with greater strength and/or stiffness for securing the accessory tool to the drive of the oscillating tool and for supporting the blade portion and allows the blade portion to be formed of a thinner metal plate that is more appropriate for performing cuts.

While the configuration of cutting blade accessory tools, such as the tool depicted in FIG. 1, enables the cutting blade to be oscillated to perform cuts in a variety of materials, the configuration also limits the depth of cuts that can be performed. The cut depth is limited by the thicker mounting interface. Therefore, the cutting depth capability of the accessory tool corresponds to the distance between the cutting edge and the edge of the mounting interface.

The cut depth of an accessory tool, such as the accessory tool of FIG. 1, may be sufficient for most jobs. However, it is not sufficient for performing some jobs, such as cutting through a standard two-by-four piece of lumber. Since two-by-fours are so widely used, it would be beneficial to provide a cutting blade accessory tool for an oscillating tool having sufficient cutting depth to cut through two-by-fours. One method that could be used to increase the cut depth of the accessory tool is to simply increase the size of the blade portion of the tool. However, increasing the length of the blade portion of the tool will result in greater inertia and consequently result in greater loads on the drive mechanism and more vibrations.

What is needed is a configuration for a cutting blade accessory tool that enables an increased cut depth without increasing the length of the cutting blade portion of the tool.

DRAWINGS

DESCRIPTION

Figure 1:
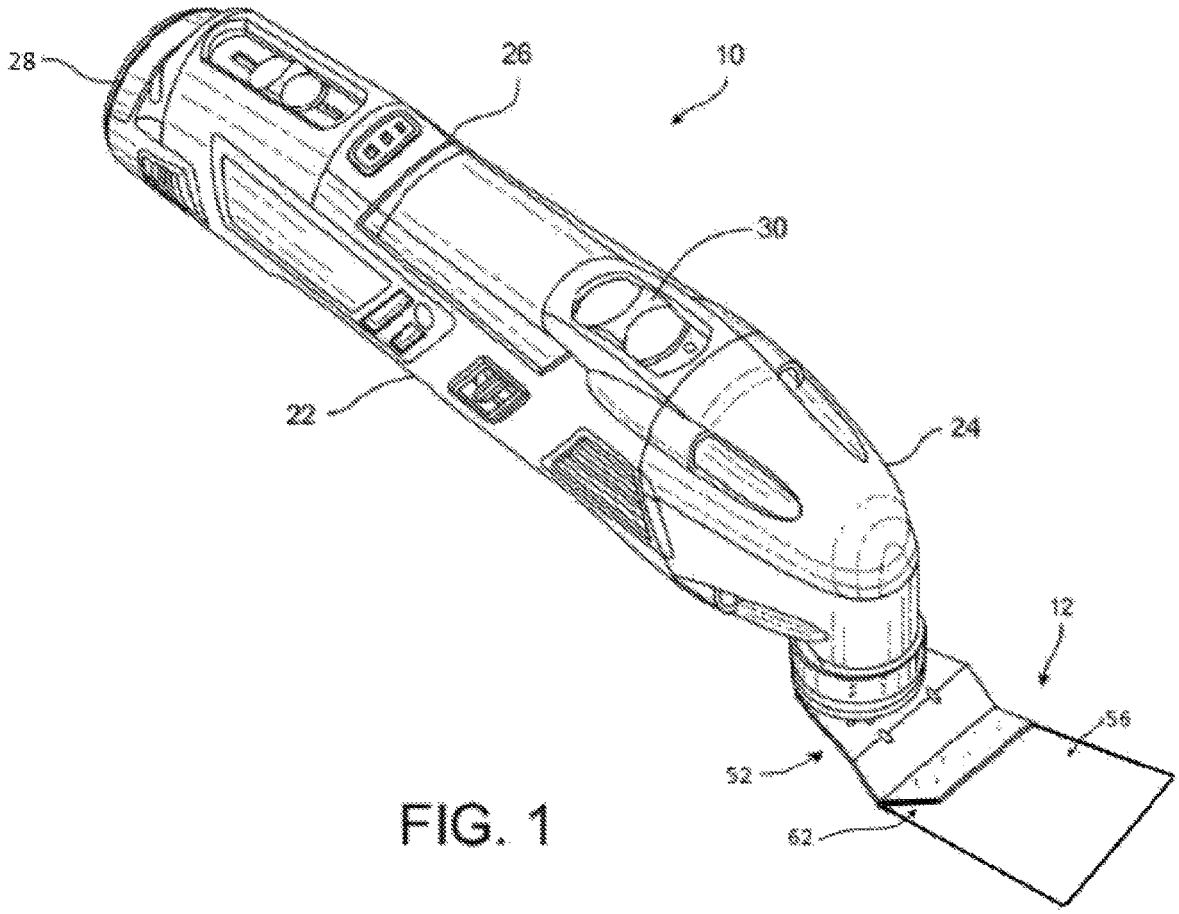
FIG. 1 is a perspective view of an oscillating tool including an accessory tool according to one embodiment the disclosure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to a person of ordinary skill in the art to which this disclosure pertains.

Referring now to FIG. 1, the disclosure is directed to a cutting blade accessory tool 12 for an oscillating power tool 10 having a mounting interface that enables cut depth to be increased without having to lengthen the blade portion of the accessory tool. The oscillating tool 10 for driving the accessory tool 12 includes a generally cylindrically shaped housing 22 constructed of a rigid material such as plastic, metal, or composite materials such as a fiber reinforced polymer. The housing 22 includes a nose portion 24 and a handle portion 26. The handle portion 26 encloses a motor (not shown). In one embodiment, the motor comprises an electric motor configured to receive power from a rechargeable battery 28 connected at the base of the handle portion 26. In other embodiments, electric power for the motor may be received from an AC outlet via a power cord (not shown). As an alternative to electric power, the oscillating power tool 10 may be pneumatically or hydraulically powered. Power to the motor is controlled by a power switch 30 provided on the handle portion 26 of the housing 22.

Figure 2:
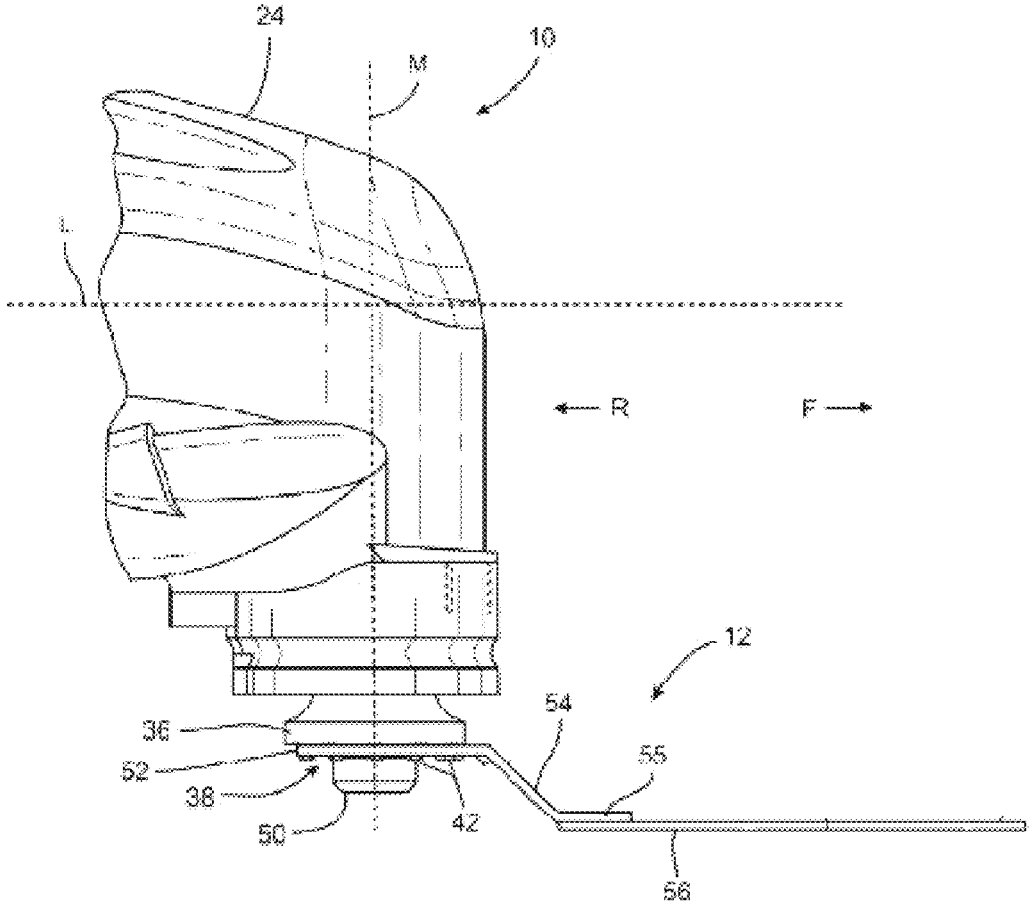
FIG. 2 is a partial view of the oscillating tool of FIG. 1 showing the nose portion of the oscillating tool.

Referring to FIG. 2, the oscillating tool 10 defines a longitudinal axis L. An oscillating drive member (not shown) extends generally perpendicularly with respect to the longitudinal axis L. The motor is configured to oscillate the drive member about an axis M at high frequencies, e.g., 5,000 to 25,000 oscillations per minute, with a small oscillating angle, typically in a range of between 0.5° and 7°. The drive member supports an accessory tool holder 36 exterior to the housing 24. The tool holder 36 is configured to releasably secure various accessory tools to the drive member, such as the accessory tool 12. As the tool holder 36 is oscillated by the drive member (not shown), the accessory tool 12 is driven to oscillate about the axis M.

To enable a secure connection between the tool holder 36 of the power tool 10 and accessory tools for use with the power tool, the tool holder 36 and associated accessory tools are provided with complementary drive structures 38, 40

(FIGS. 2 and 3) that mate to secure the accessory tool to the tool holder. In the embodiments described herein, the tool holder 36 includes a tool drive structure 38 that comprises a plurality of protrusions 42 arranged in a circular pattern about a central bore (not shown).

Figure 3:
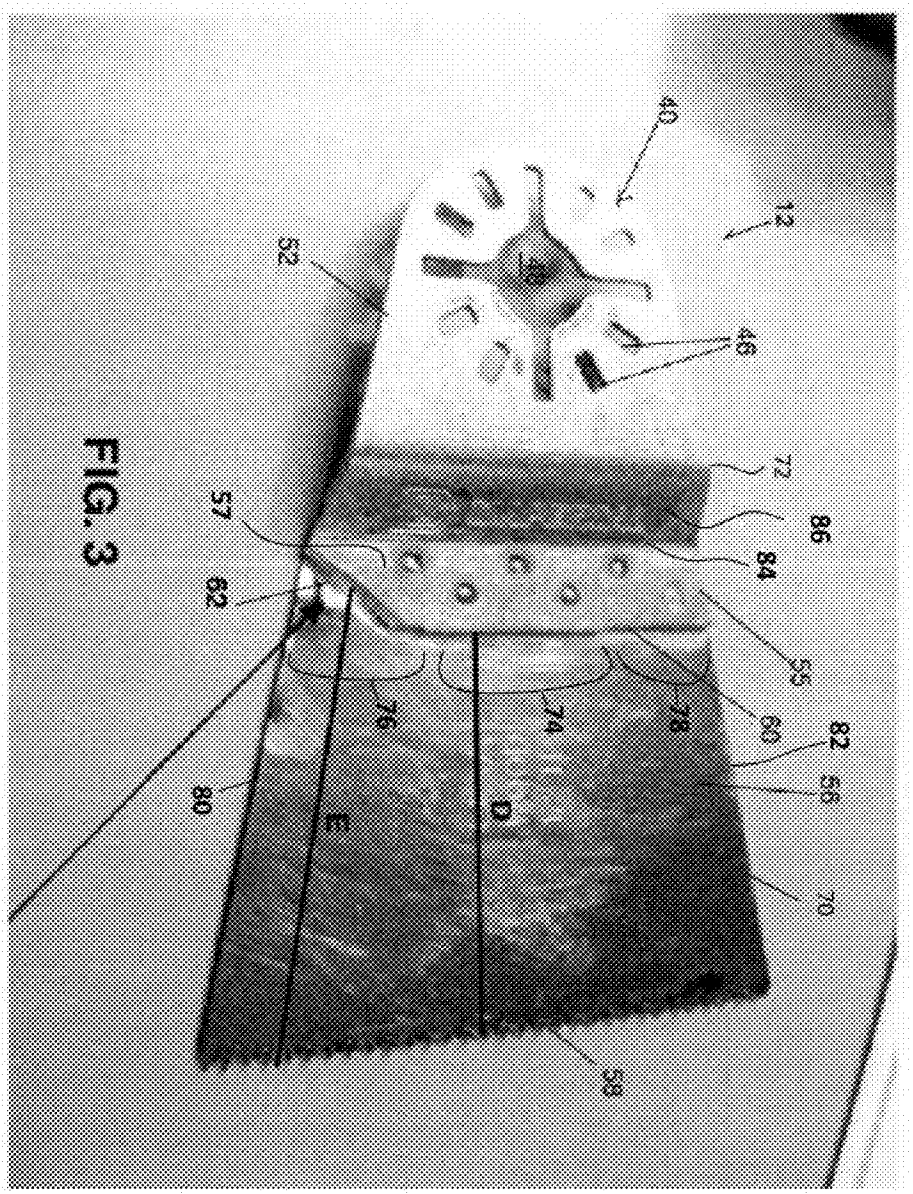
FIG. 3 is a top view of the accessory tool of FIG. 1.

Accessory tools for use with the power tool 10, such as the accessory tool 12, include an accessory drive structure 40 (FIG. 3) that is configured to mate or interlock with the tool drive structure 38 of the tool holder 36. As depicted in FIG. 3, the accessory drive structure 40 of the accessory tool 12 includes a plurality of openings or recesses 46 and a central opening 48 that are sized, shaped, and positioned complementary to the protrusions 42 and central bore, respectively, of the tool drive structure 38. When the accessory tool 12 is placed onto the tool holder 36, the protruding features 42 of the tool drive structure 38 are received in the corresponding openings and/or recesses 46 defined in the accessory drive structure 40.

A clamping member 50 (FIG. 2), such as a clamping screw, is used to press the accessory drive structure 40 of the accessory tool 12 into interlocking engagement with the tool drive structure 38 thus securing the accessory tool 12 to the tool holder 36. The interlocked drive structures 38, 40 enable the oscillating movement of the tool holder 36 to be imparted to the accessory tool 12.

The mounting portion 52 has a generally flat disc-like shape that defines the central opening 48 and surrounding openings 46 of the accessory drive structure 40. The mounting portion 40 is secured to the tool holder 36 with the mounting portion 52 and blade portion 56 arranged substantially perpendicular to the axis M of the drive member as depicted in FIG. 2. The mounting portion 52 thus oscillates substantially in a first plane, or oscillation plane, that is perpendicular to the axis M of the drive member.

The blade portion 56 of the accessory tool 12 extends from the mounting portion and includes a linear cutting edge 58. The cutting edge 58 may be serrated to define a plurality of cutting teeth, as depicted in FIG. 3, although the cutting edge 58 may have any suitable configuration for performing cuts.

In accordance with the disclosure, the mounting portion 52 and the blade portion 56 are formed of separate metal plates 70, 72. The metal plates 70, 72 are fixed together to form an accessory tool body having a first end portion formed by the first metal plate 70 and a second end portion formed by the second metal plate 72. The first end portion corresponds to the blade portion 56 and has a linear cutting edge 58. The second end portion corresponds to the mounting portion 52 which defines a drive structure 40 for mounting the accessory tool 12 onto the tool holder of the oscillating tool.

Referring again to FIG. 3, the first and second metal plates 70, 72 are secured to each other in an overlapping region 55 of the plates. As can be seen in FIG. 3, the second metal plate 72 forming the mounting portion includes an overlapping portion 57 that overlaps a trailing portion of the first metal plate 70 to form the overlapping region 55. The plates 70, 72 are fixedly secured to each other in the overlapping region 55 in a suitable manner, such as by welding. The overlapping portion 57 of the second metal plate includes a leading edge 60 that faces toward the cutting edge 58 and extends across the entire width of the first metal plate 70. The overlapping portion 57 also includes a trailing edge 84 located rearwardly from the leading edge 60. The second plate 72 may include a folded or bent portion 86 that forms a step down transition from a first planar portion of the second metal plate which forms the drive structure 40 and a second planar portion which forms the overlapping portion 57.

The distance between the leading edge 60 of the mounting portion in the overlapping region 55, also referred to herein as the interface region, and the cutting edge 58 of the blade defines a cut depth D for the accessory tool. To enable the cut depth to be increased without having to increase the length or alter the dimensions of the accessory tool, the leading edge 60 of the second metal plate is formed with a cutout, recess, or notch, referred to herein as a clearance 62, adjacent at least one lateral side of the plates. The clearance 62 increases the distance between cutting edge and the notched portion of the leading edge 60 relative to the distance between the cutting edge and the rest of the leading edge 60. As can be seen in FIG. 3, a clearance 62 is provided in a lateral portion of the leading edge 60 which enables a cut depth E which is greater than the cut depth D provided by the rest of the leading edge 60 with respect to the cutting edge 58.

Figure 4:
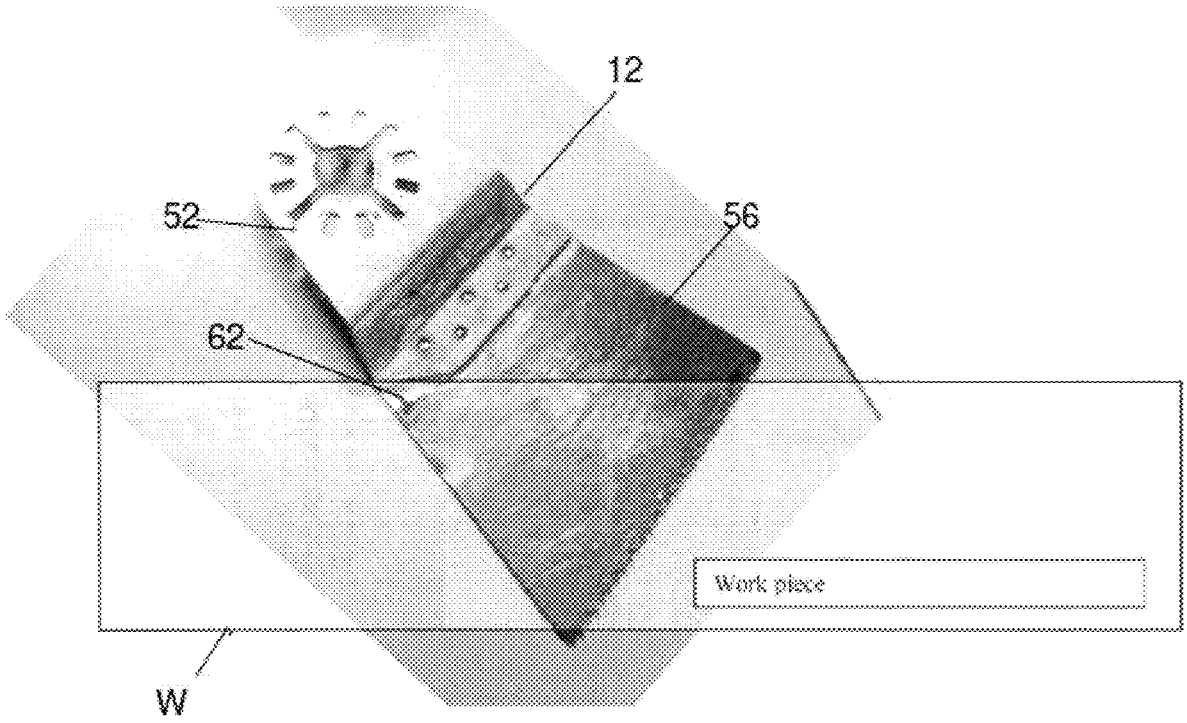
FIG. 4 is another view of the accessory tool of FIG. 1.

The position and depth of the clearance 62 results in an increase in cut depth in the region of the clearance that is sufficient to cut through a standard two-by-four work piece W. As can be seen in FIG. 4, the cut depth would not be sufficient to cut through the work piece W if the clearance 62 was not formed in the leading edge. The extra thickness of the plates in the overlapping region 55 could interfere with pushing the blade through the work piece.

For the purposes of the disclosure, the leading edge 60 of the overlapping portion 57 of the second plate 72 includes a central portion 74, a first lateral portion 76, and a second lateral portion 78. The first lateral portion 76 of the leading edge 60 extends from a first lateral edge 80 of the first metal plate 70 to the central portion 74 of the leading edge. The second lateral portion 78 of the leading edge 60 extends from a second lateral edge 82 of the first metal plate 70 and an opposite side of the central portion 74 of the leading edge 60.

At least one of the first lateral portion 76 and the second lateral portion 78 is recessed with respect to the central portion 74 to increase the cut depth for at least a portion of the cutting edge. In the embodiment of FIG. 3, the first lateral portion 76 is substantially linear and extends from one side of the central portion toward the lateral edge 80 and is angled rearwardly with respect to the central portion 74 to form a clearance 62 in the overlapping region 55 adjacent the first lateral edge 80. In the embodiment of FIG. 3, the central portion 74 and the second lateral portion 78 form a linear edge that is arranged substantially parallel to the cutting edge 58.

Figure 5:
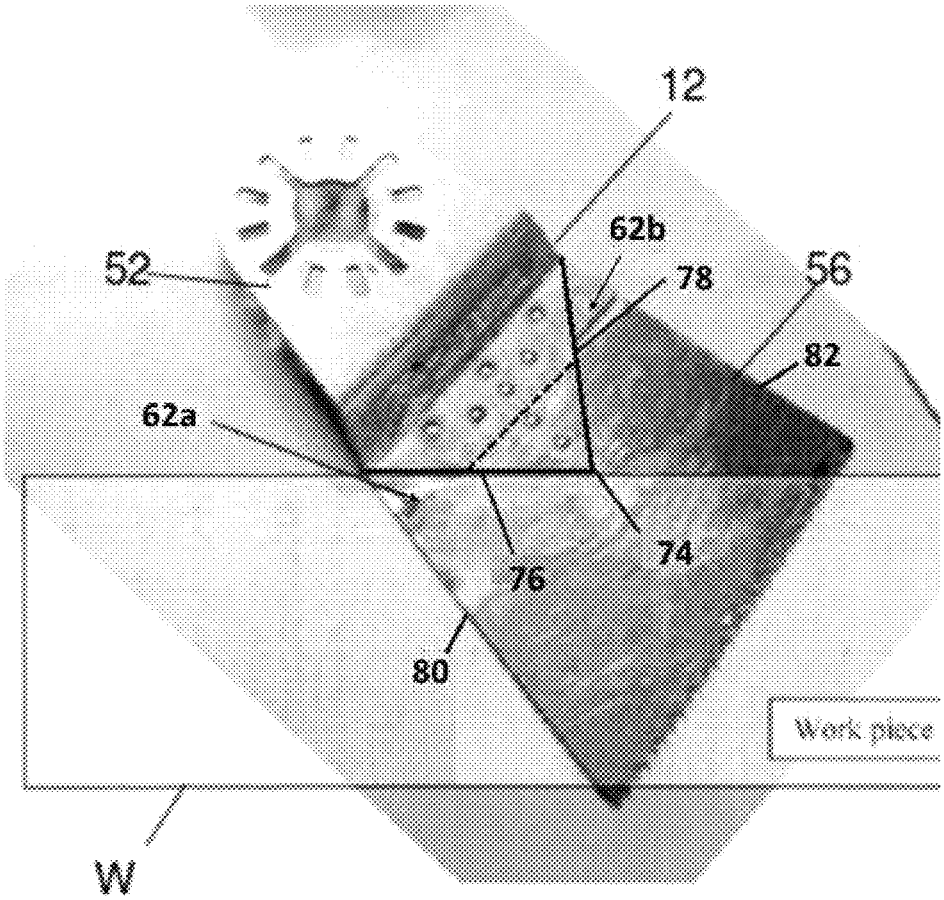
FIG. 5 depicts another embodiment of an accessory tool in accordance with the present disclosure.

In the embodiment of FIG. 3, a clearance 62 is provided on one side of the plates. In alternative embodiments, a clearance may be provided on the other side or on both sides of the central portion 74. For example, FIG. 5 depicts an embodiment in which clearances are provided on both sides of the central portion 74 of the leading edge 60. In the embodiment of FIG. 5, the first lateral portion 76 is substantially linear and extends from one side of the central portion toward the lateral edge 80 and is angled rearwardly with respect to the central portion 74 to form a clearance **62*a* in the overlapping region 55 adjacent the first lateral edge 80. The second lateral portion 78 is also substantially linear and extends from the other side of the central portion 74 toward the lateral edge 82 and is angled rearwardly with respect to the central portion 74 to form a clearance 62*b* in the overlapping region 55 adjacent the first lateral edge 82**.

In the embodiment of FIG. 5, the central portion 74 of the leading edge 60 comprises a peak in the center of the leading edge. As a result, the leading edge 60 has V-shape, or an inverted V-shape, depending on how you look at it. The overlapping portion can be used to add stiffness to the blade if desired. For example, in FIG. 5, the overlapping portion includes an extension 88 that enables more welds to be used to secure the second plate 72 to the first plate 70 as depicted in FIG. 5 while still providing clearances 62*a*, 62*b*.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. An accessory tool for an oscillating tool, the accessory tool comprising:

a first metal plate and a second metal plate fixed together to form a planar accessory tool body having a first end portion formed by the first metal plate and a second end portion formed by the second metal plate, the first end portion defining a linear cutting edge, the second end portion defining a drive interface for mounting the accessory tool onto a tool holder of an oscillating tool, wherein the second metal plate includes (i) a first planar portion that forms the second end portion of the accessory tool body and defines the drive interface, (ii) a second planar portion that includes an overlapping portion that overlaps a portion of the first metal plate and is fixed to the first metal plate, and (iii) a bent portion interposed between the first planar portion and the second planar portion that forms a step down transition between the first planar portion and the second planar portion, wherein the overlapping portion includes a leading edge that extends across an entire width of the first metal plate, wherein the leading edge includes (I) a central portion, (ii) a first lateral portion that extends between a first lateral edge of the first metal plate and the central portion, and (iii) a second lateral portion that extends between a second lateral edge of the first metal plate and the central portion, wherein at least one of the first lateral portion and the second lateral portion of the leading edge of the overlapping portion is spaced farther away from the cutting edge than the central portion, and wherein the first lateral portion of the leading edge of the overlapping portion extends linearly between the central portion and the first lateral edge, the first lateral portion being angled obliquely relative to the linear cutting edge, and rearwardly from the central portion to the first lateral edge.

2. The accessory tool of claim 1, wherein the cutting edge is wider than the overlapping portion.

3. The accessory tool of claim 1, wherein the central portion of the leading edge of the overlapping portion extends linearly across a portion of the width of the first metal plate parallel to the cutting edge.

4. The accessory tool of claim 3, wherein the second lateral portion of the leading edge of the overlapping portion extends linearly between the central portion and the second lateral edge parallel to the cutting edge and in line with the central portion.

5. The accessory tool of claim 1, wherein the second lateral portion of the leading edge of the overlapping portion extends linearly between the central portion and the second lateral edge, the second lateral portion being angled obliquely relative to the linear cutting edge, and rearwardly from the central portion to the second lateral edge.

6. The accessory tool of claim 5, wherein the leading edge has an inverted V-shape.

7. The accessory tool of claim 1, wherein the overlapping portion includes a trailing edge, the trailing edge extending linearly across the entire width of the first metal plate and being arranged parallel to the cutting edge.

* * * * *